United States Patent [19]

Sjöberg

[11] Patent Number: 4,652,481

[45] Date of Patent: Mar. 24, 1987

[54] ARTICLE FOR DEALING WITH SMALL AREAS SUCH AS DEFECTS ON A WEB OF MATERIAL

[75] Inventor: Per Sjöberg, Kreuzlingen, Switzerland

[73] Assignee: Norsel Textilmaschinen AG, Switzerland

[21] Appl. No.: 452,496

[22] Filed: Dec. 23, 1982

[30] Foreign Application Priority Data

Dec. 30, 1981 [DE] Fed. Rep. of Germany ..... 3151897
Apr. 6, 1982 [DE] Fed. Rep. of Germany ..... 3212780

[51] Int. Cl.[4] ..... B32B 15/14

[52] U.S. Cl. ..... 428/67; 156/64; 156/73.1; 156/297; 156/302; 156/353; 156/378; 250/562; 356/238; 428/78; 428/209; 428/285; 428/354

[58] Field of Search ..... 156/64, 73.1, 297, 300, 156/302, 353, 378, 379; 428/67, 78, 209, 285, 354; 340/568, 572, 675, 676; 356/237, 238; 250/559, 562, 567, 572, 571, 566

[56] References Cited

U.S. PATENT DOCUMENTS

| | | | |
|---|---|---|---|
| 2,330,497 | 9/1943 | Larmour | 41/35 |
| 3,022,814 | 2/1962 | Bodine | 156/73 |
| 3,105,151 | 9/1963 | Nash | 250/219 |
| 3,146,431 | 8/1964 | Belts | 340/259 |
| 3,274,390 | 9/1966 | Umbel | 250/219 |
| 3,508,995 | 4/1970 | Thompson | 156/364 |
| 3,783,061 | 1/1974 | Hahn | 156/73 |
| 3,861,983 | 1/1975 | Harrel | 156/361 |
| 3,960,639 | 6/1976 | Kudo | 156/222 |
| 3,962,730 | 6/1976 | Robinson | 340/675 X |
| 4,083,737 | 4/1978 | Foote, Jr. et al. . | |
| 4,532,167 | 7/1985 | Mohr | 428/78 |

*Primary Examiner*—Robert A. Dawson
*Attorney, Agent, or Firm*—Roberts, Spiecens & Cohen

[57] ABSTRACT

A method and apparatus for dealing with small areas such as defects in a web of material provide that pre-prepared marking plates with metal inserts are associated with each of the areas to be dealt with, the marking plates being joined to the web of material in such a way that the metal insert covers the area to identify same. The metal insert can be subsequently detected to permit the marked location to be removed from the web or otherwise processed.

12 Claims, 5 Drawing Figures

Fig.3
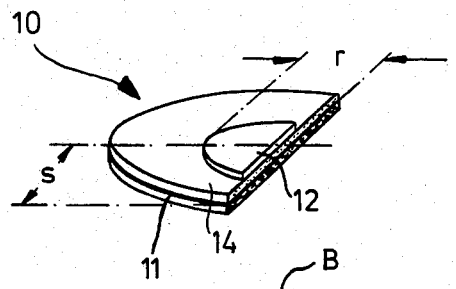
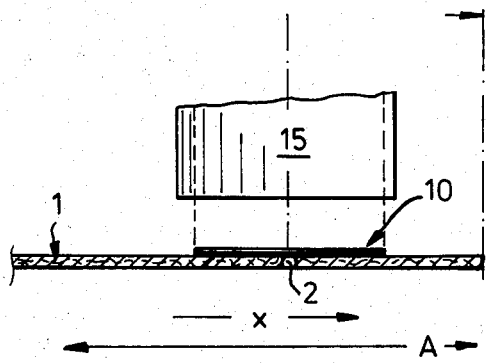
Fig.1
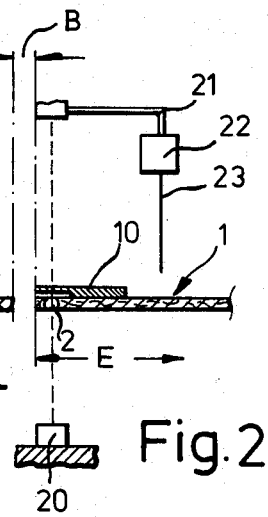
Fig.2
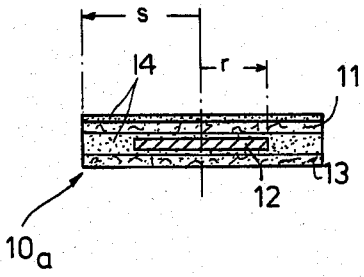
Fig.4

ARTICLE FOR DEALING WITH SMALL AREAS SUCH AS DEFECTS ON A WEB OF MATERIAL

BACKGROUND OF THE INVENTION

The invention relates generally to a method and apparatus for processing materials such as woven fabrics or the like, and more specifically for dealing with defects, which may be of restricted areas down to a punctiform configuration, in webs of fabric or like strips of material, during processing and manufacture thereof.

A particular problem which occurs in processing and manufacturing webs and strips of textile material, more particularly the fabrics which are referred to as tubular fabrics, is that of eliminating defects which, in an article of clothing or the like, made from the fabric, would result in the article being rejected. Usually, when portions of webs of material which have such defects are discovered, those portions are cut out before the remainder of the processing or manufacturing operation is performed. That gives rise to considerable disadvantages, having regard to the nature of the processing or manufacturing operation, which should be as continuous as possible.

SUMMARY OF THE INVENTION

An object of the present invention is to provide a method and apparatus for dealing with defects in webs and portions of material without having to interrupt the material processing operation.

Another object of the present invention is to provide a method and apparatus for detecting defects in a strip of material during processing thereof, and retaining identification of the location of the defects detected.

Still another object of the present invention is to provide a method of detecting defective locations in a web of material, reliably and automatically.

A yet further object of the present invention is to provide a method of detecting and identifying defective locations in a web of fabric, such that the results of the detection operation can be usefully employed for more easily controlling subsequent steps in the process of dealing with the material concerned.

These and other objects are achieved by the method according to the present invention, for dealing with areas of restricted or even punctiform size, such as defects, in webs of fabric or like strips of material, wherein pre-prepared marking plates or like members, having a metal insert or metal means thereon, are associated with any defect or like location detected, the marking plates or like members being joined to the fabric or material in such a way that the metal insert or metal means thereof extends over the respective location detected. The marking plates are applied to the detected locations or defects in such a way as to be resistant to subsequent processing of the fabric or like material.

Where reference is made hereinbefore to processing to which the marking plates are to be resistant, such processing comprises for example mechanical and/or chemical treatment or post-treatment of fabric, textile composite materials or the like, for example in order to improve the appearance or aspect or to produce an enhanced utility characteristic thereof. Such processing operations include for example strengthening the fabric or material with fillers, pressing, mangling, calandering, shearing, napping or dressing, fulling or milling and decatizing, and also making the material shrink-resistant, crease-resistant, easy-care and water-repellant. For that purpose, use is made of various kinds of starch, vegetable or plant mucilage, types of rubber, gluey latexes, etc, and a large number of synthetic additives. It is also possible to use alcohols, types of sugar and antiseptics-boron compounds, formalin and salicylic acids. The marking plate is therefore sufficiently resistant to influences of that kind, such as readily to withstand the processing operations and still remain adherring to the web of fabric or material after such processing.

It is only after such processing operations that the web of material is passed through a detector installation in which, in accordance with a further feature of this invention, the metal insert or metal means of the marking plate is used for automatically detecting any marked defect or like location; the detector installation includes a metal detector bar, a ray path or like device for detecting when the metal means passes therethrough, and advantageously actuates a control device which is operable to cause the strip of material containing the defect or like location to be mechanically removed from the web of material.

In a preferred aspect of the invention, the web of material is provided with a plurality of regions or zones comprising respectively different marking plates, and is passed between a plurality of monitoring stations, each of which triggers a given step in an operating process, on the basis of a given arrangement in respect of the marking plates.

The invention also concerns an ultrasonic device which is associated with an applicator gun for applying the marking plates and which joins each of the plates to the web of material or fabric.

The invention is also concerned with the marking plates which comprise at least a carrier or backing layer of suitable material with a metal insert or metal means thereon, and a layer of adhesive which covers the backing layer, on the surface which is towards the metal insert. In accordance with the principles of this invention, such marking plates are pre-prepared so as to be resistant to the above-indicated processing operations.

Further objects, features and advantages of the present invention will be set forth below in the description of preferred embodiments of the invention which are given by way of example thereof.

BRIEF DESCRIPTION OF THE DRAWINGS

FIG. 1 shows a view in longitudinal section through a part of a web of fabric, with associated operating stations, FIG. 2 shows a further portion of the FIG. 1 illustration, FIG. 3 shows a perspective view on an enlarged scale of part of a marking plate in accordance with the present invention, FIG. 4 shows a view in cross-section through another embodiment of a marking plate.

DESCRIPTION OF THE PREFERRED EMBODIMENTS

Figure 5:
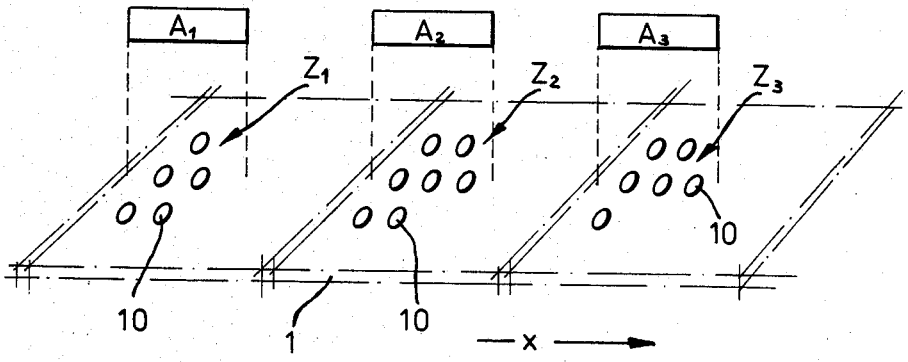
FIG. 5 shows a perspective view of another moving web of fabric or like material.

Referring firstly to FIGS. 1 and 2, a web or strip of material such as a fabric, as indicated at 1, is moved in the direction indicated by x through a monitoring or control station indicated at A, in the region of which defects or like locations, which may be of restricted size down to a punctiform configuration, as indicated at 2 in FIGS. 1 and 2, are detected by inspection equipment (not shown) or by operating personnel.

Each defect 2 in the material is marked by a marking disc 10 which, being applied to the web or portion 1 of material, passes through further processing stations as indicated generally at B but which are not shown in detail in the drawing, for the sake of enhanced clarity. After passing through the stations B, the web 1 passes into a cutting region E in which the previously detected defects 2 are detected by means of a detector 20, by virtue of the marking disc 10 associated with the respective defects. The defects 2 can thus be taken into account, when finally cutting the web 1 to size.

Referring now also to FIG. 3, a marking disc 10 as illustrated therein is of a radius which is for example 30 mm. The marking disc 10 comprises a portion of fabric or like material as indicated at 11, with a metal insert or plate as indicated at 12 fixed thereon, the radius r of the metal insert 12 being about 7 mm. The metal insert 12 comprises for example aluminum.

Referring now also to FIG. 4, shown therein is a marking plate 10*a* which is a modified form of the marking plate 10 shown in FIG. 3 and which comprises a metal insert or inlay plate 12 which is disposed between two discs or portions of fabric 11 and 13 and surrounded by a layer of adhesive 14. The upper layer of adhesive 14 is also disposed on the surface of the portion 11 in FIG. 4, and on the upper surface of the metal insert 12. The adhesive is a clear adhesive.

The portions 11 and 13 which are preferably of a circular form are pre-prepared so as to be resistant to the above-indicated processing operations, so that the marking plate 10*a* remains adherent to the web 1 of material, as it passes through the stations B.

Referring now again to FIG. 1, the marking plates 10 and 10*a* of FIGS. 3 and 4 respectively are applied to the web 1 of material by means of a gun-like device which is diagrammatically indicated at 15 in FIG. 1. The gun 15 applies the marking plate 10, 10*a* to the web 1 of material, being joined thereto by a layer of adhesive by ultrasonic means which is operated at the same time. The ultrasonic source is included in the gun device 15 but is not shown in further detail in the drawing, as ultrasonic hand devices are part of the state of the art. The adhesive is thus activated by ultrasonic effect or briefly melted during the operation of applying the marking plate to the web 1, to cause it to adhere thereto.

Referring now again to FIG. 2, the arrangement shown therein includes a detector 20 comprising the detector beam-type device which responds to the metal insert 12, although the detector may also be in the form of a metal detector bar or similar detection means. The detector 20 is connected by way of a line 21 to a control means 22 which actuates a cutter 23 when defective location 2 reaches the detector 20. It will be seen therefore that the strip of material containing the defective location can be readily cut out of the web 1, by an automatically controlled procedure.

It will be appreciated that an assembly as described above may be of particular relevance when dealing with tubular fabrics where it is generally not possible to check or monitor the side of the fabric which is remote from the viewing operator; that can now be readily achieved by the use of the metal plates and the operating means which are operatively associated therewith.

Referring now to FIG. 5, illustrated therein is a web or strip of material or fabric having a plurality of regions as indicated at Z1, Z2 and Z3, each having a plurality of marking plates or discs 10 of different configurations, that is to say, the plates or discs 10 are such that each kind of disc or plate configuration will be detected by a respective detector means. That permits corresponding receiving stations A1, A2, A3 to be supplied with different instructions so that they can trigger different operating activities, for example cutting machines or the like which are not shown in the drawing. It will be seen therefore that, as the web with the plurality of regions Z1 through Z3 with the differently detectable marking plates thereon is passed through a plurality of monitoring or control stations, each such station will initiate a given step in an operating procedure, on the basis of the respective kinds of marking plates.

Various modifications and adaptations in the above-described constructions may be made without thereby departing from the spirit and scope of the invention, for example the metal insert means in the marking plate may comprise an aluminum alloy or other suitable material. Besides controlling operation of various operating stations such as the cutter 23 in FIG. 2 for cutting the web 1 to length, the step of detecting the marking plates 10 may also be utilized to control the conveying movement of the web of material 1. It will be appreciated also that the material forming the backing member 11 and/or the layer 13 (see FIG. 4) will generally comprise a flexible material so as to adapt to the movements of the web 1 during the conveying motion thereof. It will be further appreciated that, although FIG. 5 shows three regions Z1 through Z3 and three signal-receiving stations A1 through A3, it would also be possible to provide a larger or smaller number of such regions and stations, for example with the signal-receiving stations being disposed on both sides of the path of movement of the web of material 1.

What is claimed is:

1. An article for identifying a small area in a web of material in which said web of material can be subjected to mechanical, electrical and chemical treatment to produce a material of enhanced property, said article comprising a marking plate including a first backing portion of flexible material resistant to the mechanical, electrical and chemical treatment to which said material is subjected, and a metal inlay means adhesively secured to said first backing portion and also resistant to the mechanical, electrical and chemical treatment to which said material is subjected and attachment means on said first backing portion for attachment of the marking plate to the web of material, said attachment means also being resistant to the mechanical, electrical and chemical treatment to which said material is subjected whereby said article, when affixed to said web of material, can be subjected to said mechanical, electrical and chemical treatment along with said web of material and remain in place without being substantially affected by the treatment of the web of material, said marking plate further including a second backing portion covering said metal inlay means to sandwich the metal inlay means between the first and second backing portions.

2. An article as claimed in claim 1 comprising further attachment means on said second backing portion.

3. An article as claimed in claim 1 wherein said second portion comprises textile material.

4. An article as claimed in claim 1 wherein said metal inlay means comprises aluminum.

5. An article as claimed in claim 1 wherein said metal inlay means comprises an aluminum alloy.

6. An article as claimed in claim 1 wherein said marking plate is of disc-shape.

7. An article for identifying a small area in a web of material in which said web of material can be subjected to mechanical, electrical and chemical treatment to produce a material of enhanced property, said article comprising a marking plate including a backing portion of flexible, textile material resistant to the mechanical, electrical and chemical treatment to which said material is subjected, and a metal inlay means adhesively secured to said backing portion and also resistant to the mechanical, electrical and chemical treatment to which said material is subjected and attachment means on said backing portion for attachment of the marking plate to the web of material, said attachment means also being resistant to the mechanical, electrical and chemical treatment to which said material is subjected whereby said article, when affixed to said web of material, can be subjected to said mechanical, electrical and chemical treatment along with said web of material and remain in place without being substantially affected by the treatment of the web of material.

8. An article for identifying a small area in a web of material in which said web of material can be subjected to mechanical, electrical and chemical treatment to produce a material of enhanced property, said article comprising a marking plate including a backing portion of flexible material resistant to the mechanical, electrical and chemical treatment to which said material is subjected, and a metal inlay means adhesively secured to said backing portion and also resistant to the mechanical, electrical and chemical treatment to which said material is subjected and attachment means on said backing portion for attachment of the marking plate to the web of material, said attachment means also being resistant to the mechanical, electrical and chemical treatment to which said material is subjected whereby said article, when affixed to said web of material, can be subjected to said mechanical, electrical and chemical treatment along with said web of material and remain in place without being substantially affected by the treatment of the web of material, said marking plate being of disc shape, said metal inlay means comprising a metal disc concentrically on said marking plate.

9. An article as claimed in claim 8 wherein said marking plate is made of fabric.

10. An article as claimed in claim 9 wherein said marking plate has a radius of 30 mm and said metal disc has a radius of 7 mm.

11. An article as claimed in claim 9, said attachment means comprising adhesive means which is adherent to said web of material during said treatment thereof.

12. An article as claimed in claim 7 wherein said metal inlay means is centrally located on said backing portion on one face thereof, said attachment means comprising an adhesive covering said backing portion on said one face thereof.

* * * * *